US005105480A

United States Patent [19]

Howell et al.

[11] Patent Number: 5,105,480

[45] Date of Patent: Apr. 21, 1992

[54] TOILET FLUSH VALVE APPARATUS

[76] Inventors: Anthony L. Howell, 2936 Marilyn Rd., Colorado Springs, Colo. 80909; Thomas A. Howell, 235 Embarcadero, Palo Alto, Calif. 94301

[21] Appl. No.: 625,227

[22] Filed: Dec. 10, 1990

[51] Int. Cl.[5] ..... E03D 1/14; E03D 5/07; E03D 3/12

[52] U.S. Cl. ..... 4/325; 4/402; 4/412

[58] Field of Search ..... 4/415, 402, 324, 325, 4/326, 379, 382, 412, 386

[56] References Cited

U.S. PATENT DOCUMENTS

| | | | |
|---|---|---|---|
| 3,142,846 | 8/1964 | Lackenmaier et al. | 4/402 |
| 3,380,077 | 4/1968 | Armstrong | 4/325 |
| 4,032,997 | 7/1977 | Phripp et al. | 4/415 |
| 4,080,669 | 3/1978 | Biggers | 4/325 |
| 4,216,555 | 8/1980 | Detjen | 4/415 |
| 4,504,984 | 3/1985 | Burns | 4/324 |
| 4,620,331 | 11/1986 | Sagucio | 4/324 |
| 4,837,867 | 6/1989 | Miller | 4/415 |
| 4,878,256 | 11/1989 | Bagwell | 4/326 |
| 4,937,894 | 7/1990 | Hill, Jr. et al. | 4/324 |

*Primary Examiner*—William A. Cuchlinski, Jr.
*Assistant Examiner*—G. Bradley Bennett
*Attorney, Agent, or Firm*—Richard W. Hanes

[57] ABSTRACT

A pivoting cup is mounted on the flap valve of a toilet. Two flexible actuating elements control the position of the cup. The amount of water used for a flush depends on the orientation of the cup. If the cup is selectively oriented to hold water, a partial level flush can be achieved.

4 Claims, 2 Drawing Sheets

TOILET FLUSH VALVE APPARATUS

BACKGROUND OF THE INVENTION

This invention relates to toilet flush valve systems of the type through which two different flush volumes of water may be released in order to evacuate a toilet bowl.

Toilet bowl flush systems of the foregoing type enabling the user to select two different quantities of flushing water have already been devised in connection with water conservation programs. However, such prior dual-volume flushing systems usually create certain drawbacks insofar as operational reliability and manufacturing costs are concerned.

According to one known type of dual-volume flushing system, a weighted float is used to sense the water level, and then cause the flap valve to close early, when so required. There is a latching mechanism to control whether or not the float affects the flap valve. The disadvantage of this arrangement is that the mechanism is quite complex. Such dual-volume flushing systems are disclosed, for example, in U.S. Pat. Nos. 4,764,995, 4,620,331, 4,811,432, and 4,455,694.

Another type of dual-volume flushing system is disclosed in U.S. Pat. No. 4,837,867. This system is simple, yet has the disadvantages that the water does not flow freely and with force when the smaller volume is selected. Also, the user must hold the actuator for the duration of the flush when the smaller volume is selected.

Another type of dual-volume flushing system is disclosed in U.S. Pat. No. 4,504,984. This system is complex in that it requires two flap valves and two valve seat openings. Such a system is relatively difficult to install.

SUMMARY OF THE INVENTION

It is an object of the present invention to provide a dual-volume flush valve system for a toilet that is low in cost and mechanically simple.

It is a further object of the invention to provide a dual-volume flush valve system for a toilet which can provide a strong water flow for either of the volumes selected.

In the present invention, a pivoting cup is attached to a buoyant flap valve of a toilet. Two separate flexible force transmitting elements in the form of actuating chain sections depending from two separate flush levers are connected to the cup independently of each other.

Upward displacement of one of the flush levers opens the flap valve and causes one chain section to move the cup to its upright position. The upright cup remains full of water as the toilet flushes. When the water level in the tank drops below the cup, the weight of the cup full of water pushes on the flap valve and causes it to close early for a lower volume flush.

Upward displacement of the other flush lever opens the flap valve and causes the other chain section to leave the cup in the tipped-over position. The cup in this orientation does not catch any water and therefore does not affect the flap valve. The flap valve remains open as the entire contents of the tank flow into the toilet bowl.

These, together with other objects and advantages which will become subsequently apparent, reside in the details of construction and operation as more fully hereinafter described and claimed, reference being made to the accompanying drawings forming a part hereof, wherein like numerals refer to like parts throughout.

DETAILED DESCRIPTION OF PREFERRED EMBODIMENT

Figure 1:
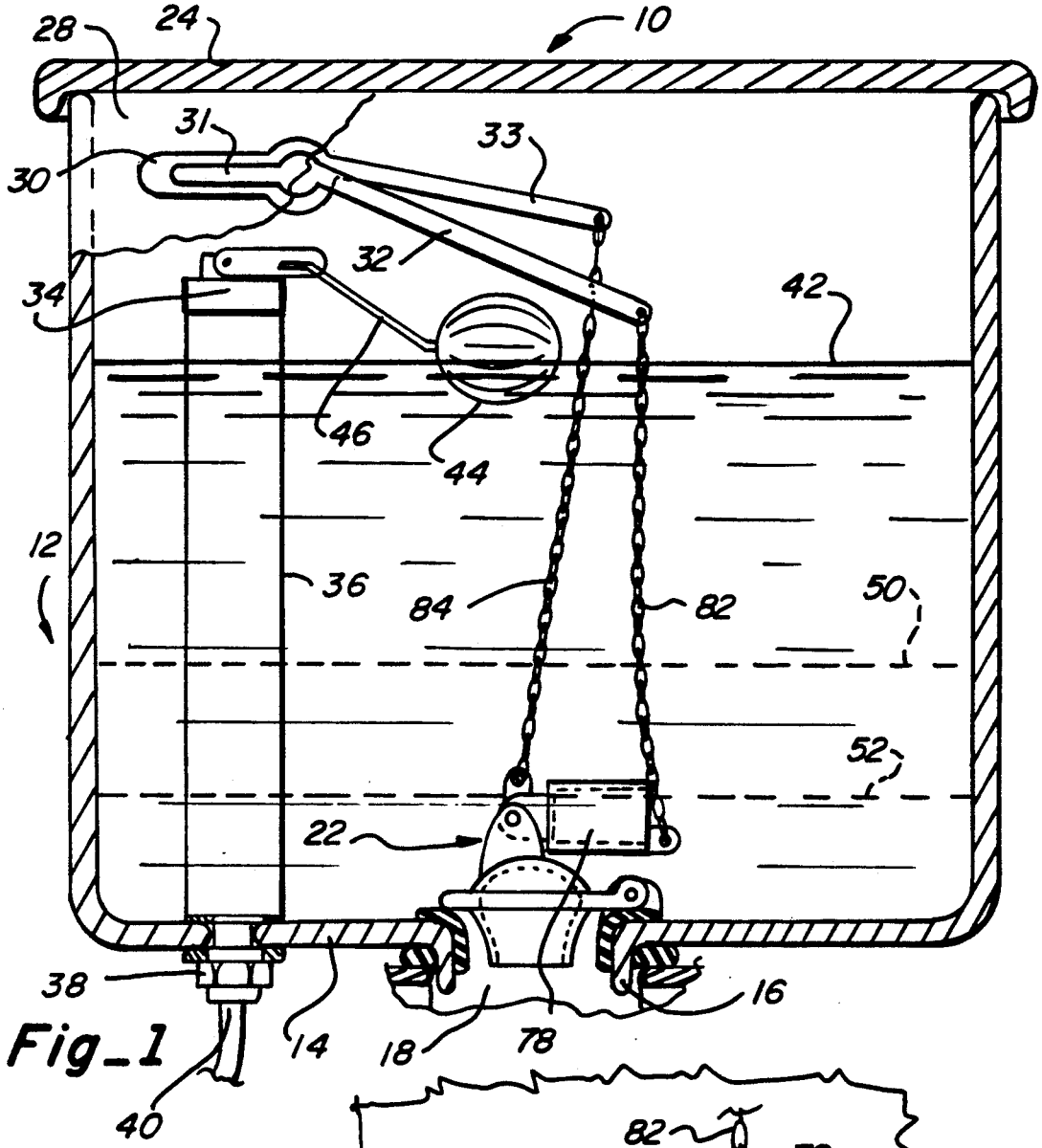
FIG. 1 is a front elevational view of a toilet flush tank with parts broken away.

Referring now to the drawings in detail, a toilet flush system generally referred to by reference number 10 is shown in FIG. 1. The flush system includes a conventional flush tank 12 having a bottom wall 14 provided with a central opening 16 through which a tubular outlet 18 leads to the toilet bowl. A cover 24 is removably supported on the opened upper end of the tank 12. The tank has a back wall, two side walls, and a wall front 28. A pair of flush control handles 30, 31 are mounted adjacent an upper end corner portion of front wall 28.

Each flush control handle is pivotally mounted to an associated flush lever 32 or 33 by well known means. In the preferred embodiment, handle 31 is for low volume flushes and is connected to lever 32. Handle 30 is for full volume flushes and is connected to lever 33. If desired, the connections could be reversed for the smaller handle 31 to be associated with full volume flushes and the larger handle 30 with smaller volume flushes without affecting the invention.

In the preferred embodiment, when handle 30 is depressed, lever 33 will pivot or be displaced upward. When handle 31 is depressed, lever 32 will correspondingly pivot or be displaced upward.

Except for the valve assembly 22 and its associated actuating means 30, 31 and connections, the toilet flush system 10 can be any conventional system. As part of such a conventional toilet flush system, a fill valve 34 is mounted on top of a vertical inflow tube 36 (dashed lines) extending from the bottom wall 14 of the tank to which it is secured by a jam nut 38. The inflow of flush water is conducted through the lower projecting inlet end portion 40 of the fill tube 36. The fill valve is closed when the water within the tank reaches a normal water level 42. Such closing of the fill valve 34 is effected by means of a conventional float 44 mounted at the end of a valve operating lever element 46.

The toilet flush operation is initiated by opening of the flush valve assembly 22 in response to upward displacement of either flush lever 32 or 33, causing the water level within the tank to drop. The float lever 46 will accordingly also drop and thereby open the fill valve 34 causing an inflow of water until the valve assembly 22 is closed and the water level returns to the normal upper level 42.

In accordance with the present invention, the water within the tank drops to either a partial flush level 50 or a full flush level 52 in response to upward displacement of the associated flush lever 32 or 33. The flush valve assembly 22, as more clearly seen in FIGS. 1, 2 and 3, includes a valve body generally referred to by reference numeral 54, formed integrally with valve seat 62 and connected to pivot support 70. Pivot support 70 projects laterally from the valve body 54 just above the valve seat opening 62 in order to pivotally mount a buoyant flapper-type valve element 74. Cup pivot bracket 76 is molded or attached to flapper valve 74. Cup 78 is pivotally attached to cup pivot bracket 76 at pivot point 72 by a pivot pin carried by cup 78 and is freely rotatable. Thus, cup 78 pivots freely, the limits of such pivotal motion being constrained by the geometry of cup 78 and pivot bracket 76.

Figure 2:
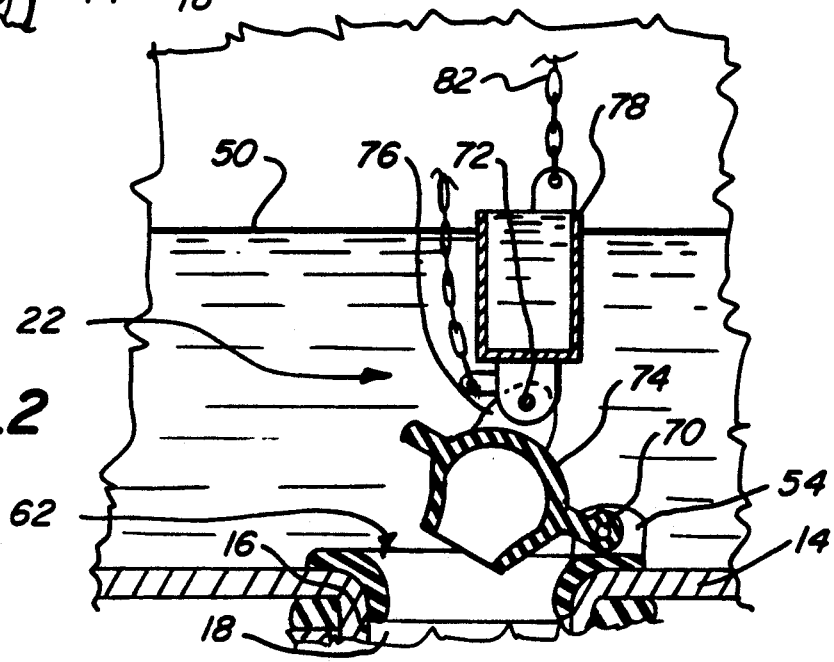
FIG. 2 is an enlarged front detail view in cross section showing the assembly in a partial flush stage of operation.
Figure 3:
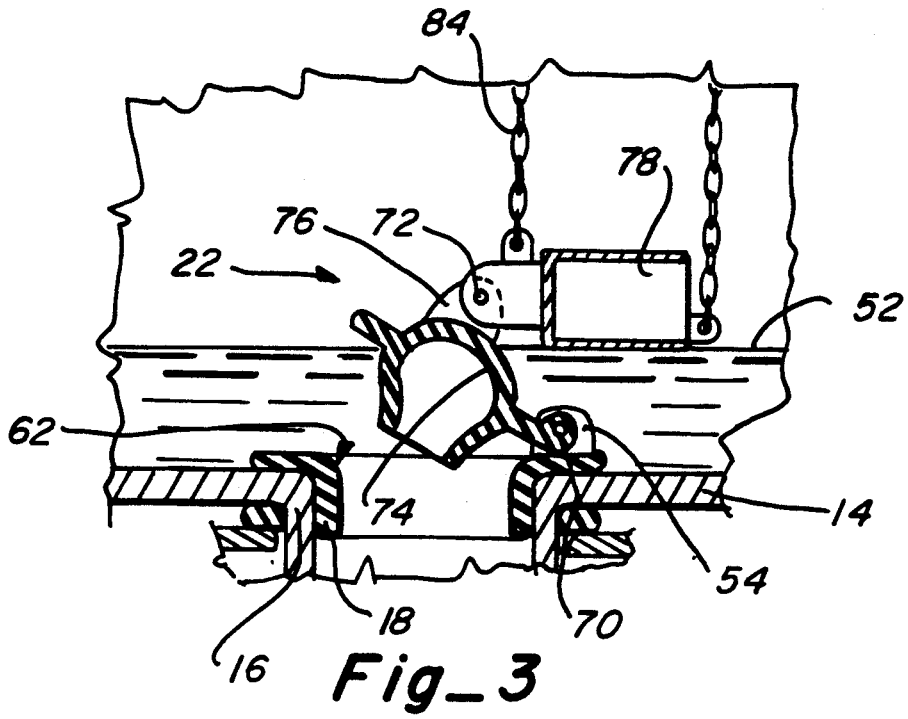
FIG. 3 is an enlarged detail view in cross section showing the assembly in a full flush stage of operation, but wherein the entire volume of water in the tank is being delivered to the toilet bowl.

Chain 82 is attached to cup 78 at its open end. Upward motion of chain 82 will cause flap valve 74 to open and leave cup 78 pointing up, forming a closed body portion to retain water, as shown in FIG. 2. Chain 84 is attached to the bottom of cup 78. Upward motion of chain 84 will cause flap valve 74 to open and leave cup 78 in the tipped-over or empty position as shown in FIG. 3.

The operation of the dual-volume flushing system will be described with reference to FIGS. 1, 2 and 3.

In the closed condition of the flush valve assembly as shown in FIG. 1, the flush levers 32 and 33 are in their lower positions. Initial upward pivotal displacement of flush lever 32 when handle 31 is actuated will cause chain section 82 to go taut, causing pivotal displacement of flap valve 74 to an open position and will cause pivotal displacement of cup 78 into the "up" or water position as shown in FIG. 2. Accordingly, the water within the tank will drain through the valve body 54 to the partial flush level 50. At this point, weight of water in cup 78 will cause downward pivotal displacement of flap valve 74 to the valve closing position shown in FIG. 1.

In the closed condition of the flush valve assembly as shown in FIG. 1, the flush levers 32 and 33 are in their lower positions. Initial upward pivotal displacement of flush lever 33 when handle 30 is actuated will cause chain section 84 to go taut, causing pivotal displacement of flap valve 74 to an open position and will cause pivotal displacement of cup 78 into the "tipped-over" or empty position as shown in FIG. 3. Accordingly, the water within the tank will drain through the valve body 54 to the full flush level 52. Cup 78 will not hold water in this position and will not affect the conventional functioning of flap valve 74 which will close at this point.

Figure 4:
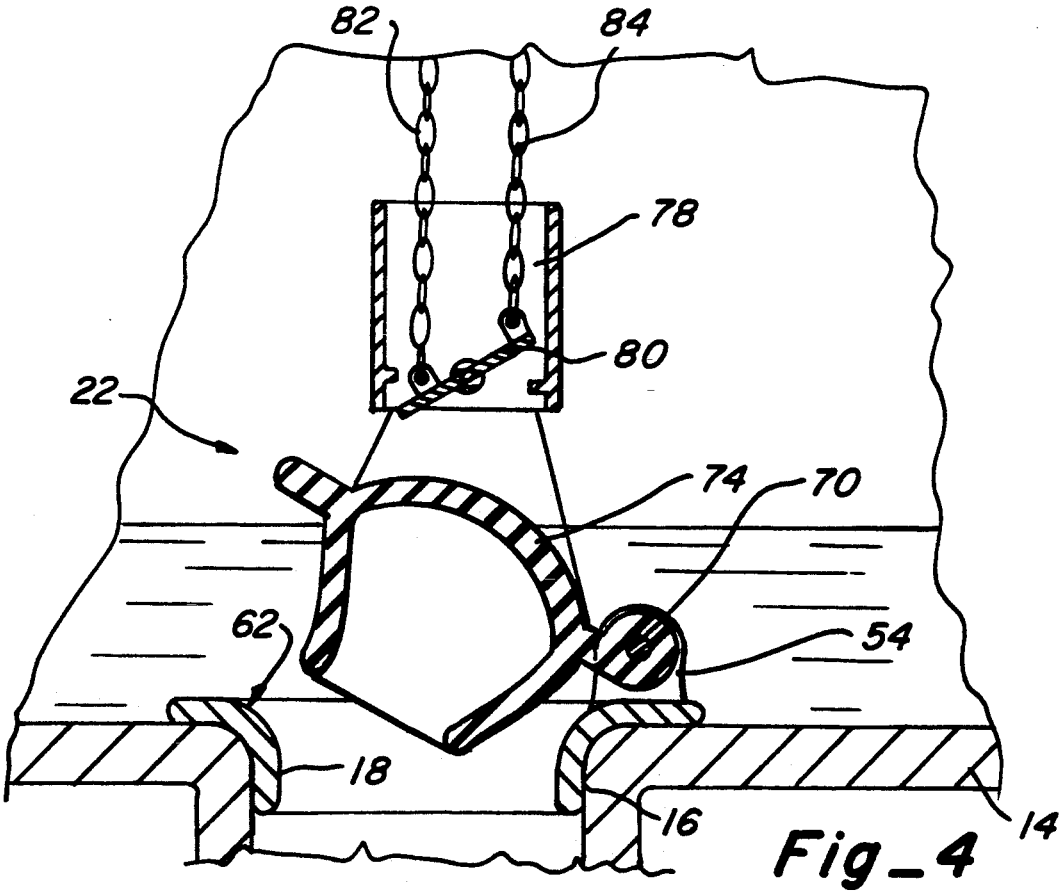
FIG. 4 is an enlarged detail view in cross section illustrating a variation of the present invention wherein the cup does not rotate, but has a valve in the bottom.

FIG. 4 illustrates a variation of the invention wherein cup 78 is mounted in a fixed orientation to flap valve 74. The function of cup 78 to either retain water, or not retain water, is accomplished by pivot valve 80. Chain 84 moved by lever 33 when a full volume flush is desired opens pivot valve 80 so cup 78 cannot hold water. Chain 82 moved by lever 32 when a partial volume flush is desired closes pivot valve 80 so cup 78 can hold water and the operation continues as in the embodiment of FIGS. 1, 2 and 3.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A dual-volume valve flushing system for a toilet comprising:
- a flush tank,
- an outlet for said tank through which water from said tank can pass,
- a valve body connected to said outlet,
- a flap valve movably mounted on the valve body for movement from an open position where water can pass through said outlet, to a closed position where water cannot pass through said outlet,
- a chamber means mounted for movement with said flap valve,
- a first actuating means for moving said flap valve to said open position and for moving said chamber means to a closed water retaining position, and
- a second actuating means for moving said flap valve to said open position and for moving said chamber to an open empty position,
- wherein said first actuating means comprises a first movable lever and means for connecting said first movable lever to said chamber means at a first location and said second actuating means comprises a second movable lever and means for connecting said second movable lever to said chamber means at a second location different from said first location,
- whereby said flushing system uses a first volume of water when said chamber means is in said closed water retaining position, and said flushing system uses a second volume of water different from said first volume when said chamber means is in said open empty position.

2. The flush system of claim 1 wherein said chamber means is a cup having a closed bottom and an open top and said first location is near said top of said cup and said second location is near said bottom of said cup.

3. A dual-volume valve flushing system for a toilet comprising:
- a flush tank,
- an outlet for said tank through which water from said tank can pass,
- a valve body connected to said outlet,
- a flap valve movably mounted on the valve body for movement from an open position where water can pass through said outlet, to a closed position where water cannot pass through said outlet,
- a chamber means mounted for movement with said flap valve,
- a first actuating means for moving said flap valve to said open position and for moving said chamber means to a closed water retaining position,
- a second actuating means for moving said flap valve to said open position and for moving said chamber to an open empty position,
- a first handle mounted on the exterior of said tank connected to said first actuating means, and
- a second handle mounted on the exterior of said tank connected to said second actuating means
- whereby said flushing system uses a first volume of water when said chamber means is in said closed water retaining position, and said flushing system uses a second volume of water different from said first volume when said chamber means is in said open empty position.

4. The flush system of claim 3 wherein the two handles are co-axially mounted.

* * * * *